United States Patent [19]

Honegger

[11] Patent Number: 4,651,939

[45] Date of Patent: Mar. 24, 1987

[54] APPARATUS FOR ALIGNING A STRAP UNWINDING FROM A ROLL OR THE LIKE WITH A GUIDE OR TAKE-UP MEMBER

[75] Inventor: Werner Honegger, Tann-Rüti, Switzerland

[73] Assignee: Ferag AG, Hinwil, Switzerland

[21] Appl. No.: 686,827

[22] Filed: Dec. 27, 1984

[30] Foreign Application Priority Data

Jan. 10, 1984 [CH] Switzerland ..... 102/84

[51] Int. Cl.[4] ..... B65H 18/02; B65H 23/32; B65H 75/00

[52] U.S. Cl. ..... 242/55; 242/59; 242/76

[58] Field of Search ..... 242/59, DIG. 2, 76, 242/55, 67.1 R, 430; 53/116, 117, 118, 119

[56] References Cited

U.S. PATENT DOCUMENTS

| | | | |
|---|---|---|---|
| 2,194,879 | 3/1940 | Von Mihaly et al. | 242/76 |
| 3,309,037 | 3/1967 | Amos | 242/76 X |
| 3,388,873 | 6/1968 | Rosenbaum | 242/76 X |
| 3,519,218 | 7/1970 | Mees | 242/76 |
| 3,921,929 | 11/1975 | Jöres et al. | 242/76 |
| 3,961,763 | 6/1976 | Somers | 242/76 X |

FOREIGN PATENT DOCUMENTS

| | | |
|---|---|---|
| 1068800 | 5/1967 | United Kingdom . |
| 2107681 | 5/1983 | United Kingdom . |

OTHER PUBLICATIONS

Winding Machine of Belt-Shaped Material (Japanese Patent 58-59148 Abstract) Hitachi.

*Primary Examiner*—Stuart S. Levy
*Assistant Examiner*—Lynn M. Sohacki
*Attorney, Agent, or Firm*—Werner W. Kleeman

[57] ABSTRACT

A winding or partitioning strap unwinding from a coil or wound package of printed products as the printed products are unwound is guided through a guide which turns the winding or partitioning strap temporarily through approximately 90° out of its plane of motion. The winding or partitioning strap is guided in the guide at its flat sides and is aligned with a subsequently arranged deflection roll. The winding or partitioning strap runs from the deflection roll over guide rollers and is subsequently taken up or wound upon a take-up roll or bobbin core. Since the winding or partitioning strap is guided in the guide on the flat sides and not on the edges, an alignment of the winding or partitioning strap unwinding from the coil or wound package in a skew direction with the deflection roll is possible without damaging the strap.

16 Claims, 6 Drawing Figures

APPARATUS FOR ALIGNING A STRAP UNWINDING FROM A ROLL OR THE LIKE WITH A GUIDE OR TAKE-UP MEMBER

CROSS-REFERENCE TO A RELATED APPLICATION

This application is related to the commonly assigned, copending U.S. patent application Ser. No. 06/432,557, now U.S. Pat. No. 4,587,790, filed Oct. 4, 1982 and entitled "Apparatus for the Storage of Flat Products Arriving in an Imbricated Formation, Especially Printed Products".

BACKGROUND OF THE INVENTION

The present invention broadly relates to winding apparatus and, more specifically, pertains to a new and improved construction of an apparatus for aligning a strap unwound from a roll or the like with a guide member or take-up or winding member.

Generally speaking, the apparatus of the present invention comprises a guide arranged between the roll and the guide member or take-up or winding member and aligned with such guide member or take-up or winding member for guiding the strap into a position rotated or turned out of the plane of motion of the strap. The guide comprises a guidance gap for the strap and which gap extends substantially at a right angle to the plane of motion of the strap.

An apparatus of this type is known from the British Pat. No. 1,068,800, published May 17, 1967, in which a winding or partitioning strap, also called a separator strap, unwinding from a supply roll is first conducted around a stationarily arranged deflection roll before it passes through an also stationary guide which rotates the strap through approximately 90° out of the plane of motion of the strap. During unwinding of the strap from the stationarily arranged supply roll, the diameter of the supply roll diminishes with the result that the direction of motion of the strap from its position of departure from the supply roll to the deflection roll changes. This change in direction has no effect upon the direction of motion of the strap moving toward the guide only because the strap is guided between the supply roll and the guide over a deflection roll, as already mentioned.

A similar apparatus is known from the Japanese Patent Application No. 56-156199, published under the No. 58-59148 on Apr. 8, 1983 (cf. also Patent Abstracts of Japan, Volume 7, No. 149, [M-225] [1294] of July 30, 1983). In this apparatus, too, the guide formed by two stationarily arranged rollers is preceded by an also stationarily arranged deflection roll over which the strap runs after being unwound from a supply roll. A corresponding amount of space is required for providing this supplementary deflection roll.

SUMMARY OF THE INVENTION

Therefore, with the foregoing in mind, it is a primary object of the present invention to provide a new and improved construction of an apparatus for aligning a strap with a guide member or take-up or winding member and which does not exhibit the aforementioned drawbacks and shortcomings of the prior art constructions.

Another and more specific object of the present invention aims at providing a new and improved construction of an apparatus of the previously-mentioned type for aligning a strap with a guide member or take-up or winding member which permits an impeccable guidance and alignment of the winding or partitioning strap during the entire unwinding procedure of the strap from the roll without damaging the strap as well as a simple and space-saving construction.

Yet a further significant object of the present invention aims at providing a new and improved apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the apparatus of the present invention is manifested by the features that the guide or guide means is moveable in a direction extending substantially transverse to the plane of motion of the strap.

Since the guide or guide means is moveable in a direction extending substantially transverse and preferably substantially at a right angle to the plane or direction of motion of the strap, the guide can readily follow the changes in this direction of motion of the strap which result from the changing diameter of the unwinding roll or wound package. The winding or partitioning strap can also be guided directly to the guide without previous deflection. This simplifies the guidance of the strap and furthermore permits a compact space-saving construction.

The apparatus according to the invention is especially but not exclusively suitable for aligning a winding or partitioning strap unwinding from a coil or wound package of printed products as such printed products are unwound from such coil or wound package with a guide or deflection roll.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
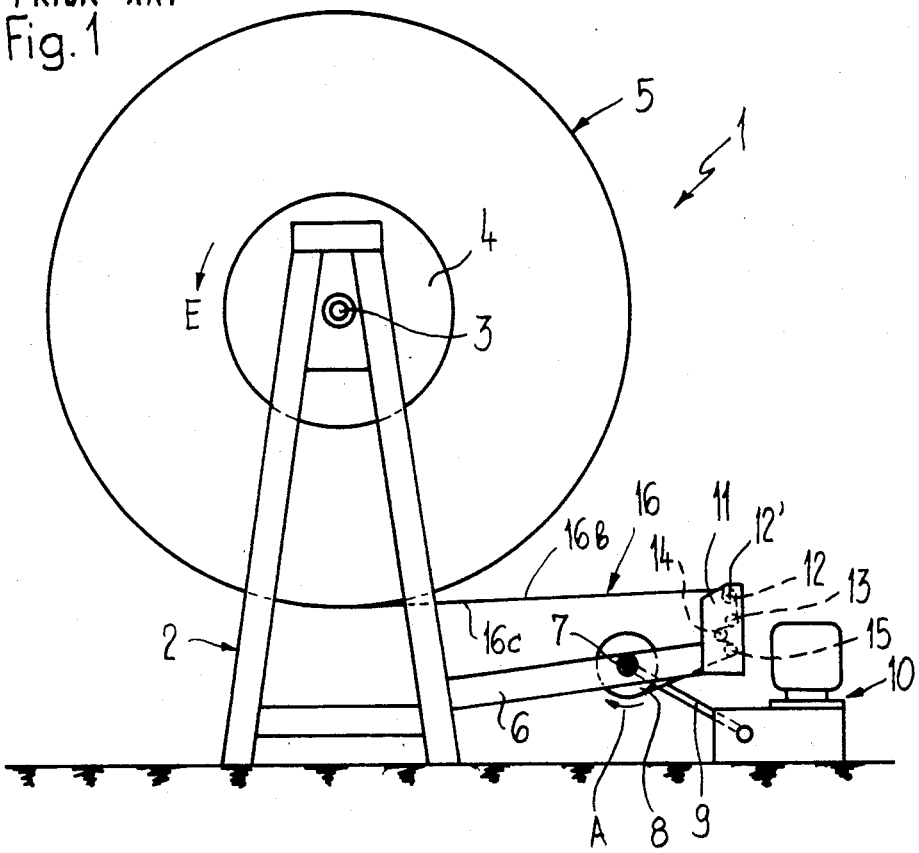
PRIOR ART Fig. 1
FIGS. 1 and 2 schematically show a conventional apparatus known to the art for unwinding a winding or partitioning strap conjointly with printed products from a coil or wound package of printed products in side and plan view, respectively.

Describing now the drawings, it is to be understood that to simplify the showing thereof only enough of the structure of the apparatus for aligning a strap with a guide member or take-up or winding member has been illustrated therein as is needed to enable one skilled in the art to readily understand the underlying principles and concepts of this invention. Turning now specifically to FIG. 1 of the drawings, the apparatus illustrated therein in elevation by way of example and not limitation is a conventional unwinding apparatus for unwinding printed products conjointly with a winding or partitioning strap or band from a coil or wound package of printed products, such as is described in more detail in the German Patent Publication No. 3,236,866 and the corresponding British Patent Publication No. 2,107,681, both cognate with the aforementioned U.S. patent application Ser. No. 06/432,577, now U.S. Pat. No. 4,587,790, filed Oct. 4, 1982. This known apparatus comprises a storage unit 1 which includes a mobile frame 2 constructed in the manner of a bearing pedestal. A shaft 2 of a cylindrical winding core or mandrel 4 is journaled in the frame 2. A not particularly shown brake device engages this shaft 3. The winding core or mandrel 4 carries a coil or . wound package of printed products which is only schematically represented and designated with the reference numeral 5. A winding or partitioning strap or band 16 is wound between the individual coil layers of the coil or wound package 5 formed by the printed products in conventional manner, as is described in more detail in the previously-mentioned German Patent Publication No. 3,236,866 and the corresponding British Patent Publication No. 2,107,681, both cognate with the aforementioned U.S. patent application Ser. No. 06/432,577, now U.S. Pat. No. 4,587,790.

The frame 2 further comprises two mutually parallel arms 6 extending in spaced relationship, only one arm 6 of which is visible in FIG. 1. A shaft 7 of a take-up or winding roll or bobbin core 8 is rotatably journaled in these arms 6. The shaft 7 is connected by a transmission 9 with a drive unit 10 comprising a motor and a gear box. The shaft 7 and the take-up roll or bobbin core 8 are rotated in the direction of the arrow A by this drive unit 10. Bearing plates 11 are also mounted on these arms 6, only one of which is visible in FIG. 1. A deflection or guide roll 12 as well as guide rolls 13, 14 and 15 are rotatably journaled in these bearings plates 11. The deflection roll 12, whose axis of rotation is designated with the reference numeral 12', comprises lateral guide webs or flanges **12*a* and 12*b* (cf. FIG. 2). The flexible winding or partitioning strap 16 unwinding from the coil or wound package 5 may be made of a tension-resistant material, e.g. of plastic, and is guided over the deflection roll 12 between the guide flanges 12*a* and 12*b* of such deflection roll 12 and subsequently runs over the guide rolls 13, 14 and 15 to the take-up or winding roll or bobbin core 8. The winding or partitioning strap 16 runs substantially in a plane between the coil or wound package 5 and the deflection roll 12. This plane of motion of the winding or partitioning strap 16 substantially coincides with the plane of the drawing in FIG. 2** and is designated with the reference character B.

If the shaft 7 and with it also the take-up roll or bobbin core 8 are driven in the direction of the arrow A by the drive unit 10, and the winding or partitioning strap 16 and therefore also the printed products wound up on the coil or wound package 5 are unwound, as is described in more detail in the previously-mentioned German Patent Publication No. 3,236,866 and the corresponding British Patent Publication No. 2,107,681, both cognate with the aforementioned U.S. patent application Ser. No. 06/432,577, now U.S. Pat. No. 4,587,790, filed Oct. 4, 1982, then the coil or wound package 5 is set into rotation in the direction of the arrow E. The winding or partitioning strap 16 unwinding from the coil or wound package 5 is wound up on the take-up roll or bobbin core 8.

Figure 2:
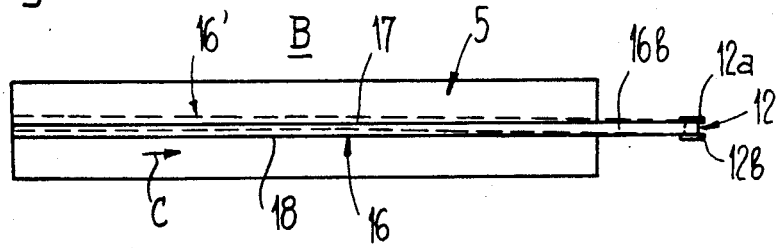
PRIOR ART Fig. 2
Figure 6:
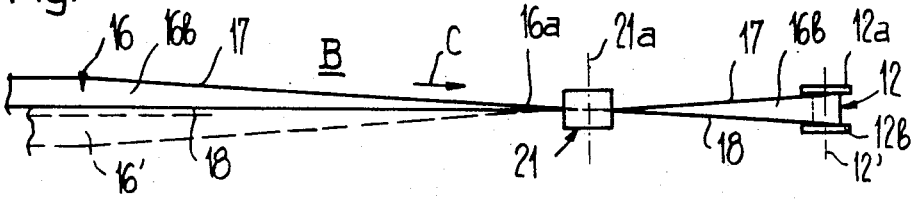
FIG. 6 schematically shows a plan view of the winding or partitioning strap moving toward the deflection or guide roll on an enlarged scale in relation to FIG. 4, the coil or wound package being, in contrast to FIG. 4, not particularly shown.

Since not all layers or windings of the winding or partitioning strap 16 are exactly aligned with one another within the coil or wound package 5, the direction of motion C of the winding or partitioning strap 16 unwinding from the coil or wound package 5 is not always aligned with the deflection roll 12. This means that the winding or partitioning strap 16 can run onto the deflection roll 12 in a skew direction, as is represented in FIG. 2 by the winding or partitioning strap 16' in dotted line. If the winding or partitioning strap 16 runs skewly onto the deflection roll 12, which guides the winding or partitioning strap 16 at the edges 17 and 18 by the guide flanges **12*a* and 12*b*, then it can occur that the winding or partitioning strap 16 is turned up and subsequently turned over by the action of one of the guide flanges 12*a* or 12*b* in the region of a strap edge 17 or 18. Additionally, there is a danger of damaging the winding or partitioning strap 16** in its edge region.

It can furthermore occur that the winding or partitioning strap 16 climbs up on a guide flange **12*a* or 12*b*. Since the flexible winding or partitioning strap 16 does not have a sufficiently great inherent rigidity, there is a danger of damaging or deforming the winding or partitioning strap 16 or of interfering with the operation of winding up the winding or partitioning strap 16 on the take-up or winding roll or bobbin core 8 when the winding or partitioning strap 16 runs skewly onto the deflection roll 12**.

An apparatus is illustrated in FIGS. 3 through 6 in which it is ensured that the winding or partitioning strap 16 always runs onto the deflection roll 12 in alignment, independent of the direction in which the winding or partitioning strap 16 unwinds from the coil or wound package 5.

The apparatus shown in FIGS. 3 through 6 generally corresponds to the apparatus according to FIGS. 1 and 2. This apparatus 1 comprises, however, in contrast to the apparatus of FIGS. 1 and 2, an alignment device or apparatus 19 for the winding or partitioning strap 16 (cf. FIG. 3). Components in FIGS. 3 through 6 analogous to those of FIGS. 1 and 2 are generally conveniently designated with the same reference numerals.

Figure 3:
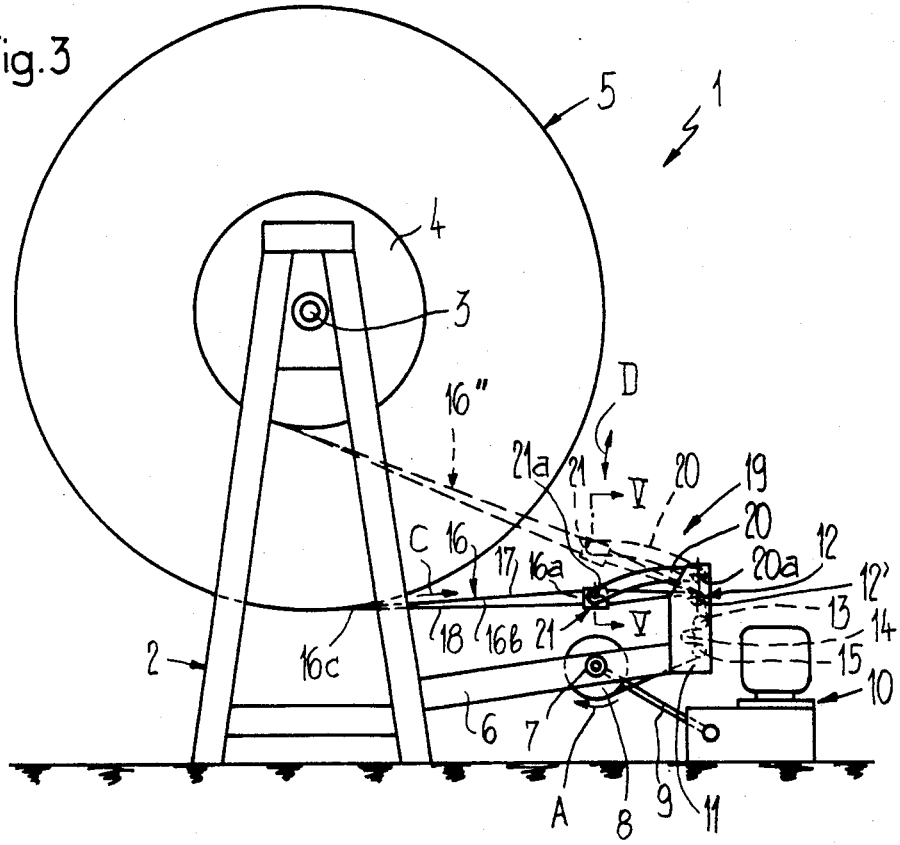
FIGS. 3 and 4 schematically show an apparatus for unwinding a winding or partitioning strap conjointly with printed products from a coil or wound package of printed products which is equipped with an aligning apparatus for the winding or partitioning strap according to the invention in a representation corresponding to FIG. 1, respectively FIG. 2, i.e. in side view, respectively plan view.
Figure 4:
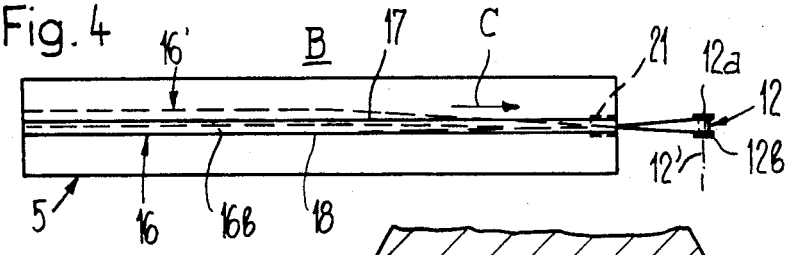
Figure 5:
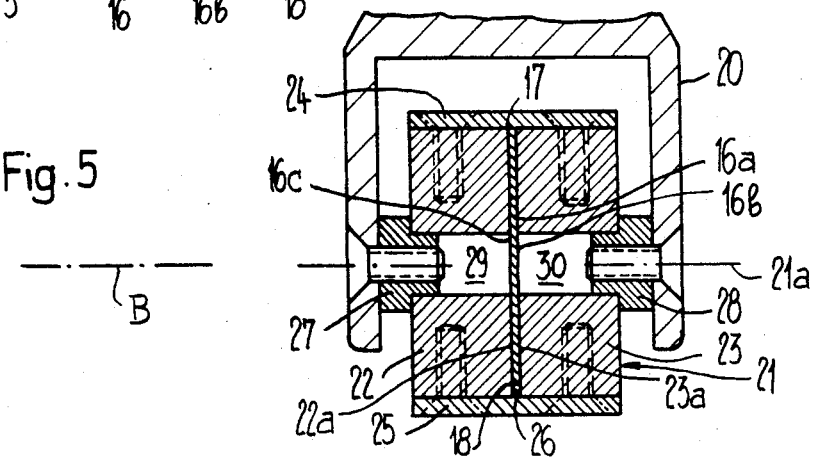
FIG. 5 schematically shows a section taken along the line V—V in FIG. 3 on an enlarged scale in relation to FIG. 3.

The alignment apparatus 19 comprises a lever 20, as can be particularly well seen in FIGS. 3 and 5, which is pivotbly mounted in the bearing plates 11. The pivot axis **20*a* of the lever 20 extends substantially parallel to the axis of rotation 12' of the deflection roll 12 and approximately parallel to the plane of motion B of the winding or partitioning strap 16 (cf. especially FIG. 6). The lever 20 carries a guide or guide means 21 for the winding or partitioning strap 16** at its free end.

As can be particularly well seen from FIG. 5, the guide 21 comprises two quadrangular guide plates or blocks 22 and 23 which are connected together by any suitable connecting elements 24 and 25 which define strap guard plates. Each of the two connecting elements 24 and 25 is screwed to the guide plates or blocks 22 and 23, as indicated in FIG. 5. Both guide plates or blocks 22 and 23 form a guidance gap or slot 26. The guidance gap 26 is delimited by the guide surfaces 22*a* and 23*a* of the guide plates or blocks 22 and 23, respectively. This guidance gap 26 extends approximately at a right angle to the plane of motion B of the winding or partitioning strap 16 unwinding from the coil or wound package 5. Two journal pins 27 and 28 are fixedly screwed to the lever 20 for pivotably journalling the guide or guide means 21. Each of the journal pins 27 and 28 engages in a respective bore 29 and 30 in the guide plates or blocks 22 and 23 (cf. FIG. 5). Both journal pins 27 and 28 establish or define the pivot axis 21*a* for the guide 21. This pivot axis 21*a* extends substantially parallel to the pivot axis 20*a* of the lever 20.

The winding or partitioning strap 16 unwinding from the coil or wound package 5 is guided through the guidance gap or slot 26 which, as already mentioned, is oriented approximately at a right angle to the plane of motion B of the winding or partitioning strap 16. This means that the winding or partitioning strap 16 is temporarily turned or rotated through approximately 90° out of the plane of motion B of the winding or partitioning strap 16 by the guide 21 into a substantially upright position. This upright section of the winding or partitioning strap 16 is designated with the reference numeral 16*a* in FIGS. 5 and 6. After running through the guide 21, the winding or partitioning strap 16 then returns into its plane of motion B and runs—as in the prior apparatus according to FIGS. 1 and 2—with its lower flat surface or face 16*c* over the deflection roll 12 and the guide rolls 13, 14 and 15. The winding or partitioning strap 16 is guided on its flat sides or faces 16*b* and 16*c* in the guide 21 by the guide surfaces 22*a* and 23*a* delimiting the guidance gap or slot 26. For this reason the winding or partitioning strap 16 can be guided without damage even when the winding or partitioning strap 16 unwinds from the coil or wound package 5 in misalignment with the guide 21 and runs toward the guide 21 in a skew direction. A winding or partitioning strap 16' approaching the guide 21 in such a skew direction is represented in dotted line in FIGS. 4 and 6. The winding or partitioning strap 16 represented in solid line in FIG. 6 also runs toward the guide 21 in misaligned position. Since the guide or guide means 21 is aligned with the deflection roll 12 and also remains aligned therewith, the effect is achieved that the winding or partitioning strap 16 runs onto the deflection roll 12 in alignment therewith and is guided between the guide flanges 12*a* and 12*b* of the deflection roll 12 without damage to the winding or partitioning strap 16 and without there arising a turning over of the edge regions of the winding or partitioning strap 16.

The guidance gap 26 is, as can be particularly well seen from FIG. 5, closed at top and bottom by the connecting elements 24 and 25. The connecting elements 24 and 25 therefore prevent the upright section 16*a* of the winding or partitioning strap 16 running through the guidance gap 26 from wandering out of the guidance gap 26.

The diameter of the coil or wound package 5 constantly diminishes during the unwinding procedure with the result that the section of the winding or partitioning strap 16 extending between the deflection roll 12 and the unwinding or separation location from the coil or wound package 5 changes its slope, as is indicated in FIG. 3 by the winding or partitioning strap position 16" represented in dotted line. The guide 21 can readily follow this change of slope of the winding or partitioning strap 16 due to its inherent pivotability about the pivot axis 21*a* and due to the pivotability of the lever 20, as is indicated in FIG. 3 in dotted line. The pivoting of the lever 20 in the direction of the arrow D (cf. FIG. 3) and the guide or guide means 21 is directly effected by the winding or partitioning strap 16. As shown in FIG. 5, the guide 21 and with it the lever 20 are entrained by the upright section 16*a* of the winding or partitioning strap 16 running through the guidance gap or slot 26. The upper edge 17 of this upright section 16*a* of the winding or partitioning strap 16 butts against the connecting element 24. A supplementary mechanism for adjusting the lever 20 and the guide 21 is therefore not necessary.

The guide 21 serves for temporarily deflecting or deviating the winding or partitioning strap 16 out of the plane of motion B of such winding or partitioning strap 16 and also serves to guide the winding or partitioning strap 16 on its flat sides or faces 16*b* and 16*c*. The guide 21 can also be constructed other than as shown and described. Guide rolls which may be rotatably journaled and which guide the transversely positioned or upright section 16*a* of the winding or partitioning strap 16 with their outer surfaces can, for instance, be employed instead of the quadrangular guide plates or blocks 22 and 23. It will be understood that the alignment of the winding or partitioning strap 16 with the deflection roll 12 as hereinbefore described is also possible when a deflection roll with a vertical axis of rotation is employed instead of a deflection roll 12 with a horizontal axis of rotation 12'.

Although the invention has been hereinbefore described in relation to an apparatus for aligning a winding or partitioning strap unwinding from a coil or wound package of printed products with a deflection roll, it is also possible to align flat flexible straps of any type whatsoever with a deflection roll, guide roll, turning roll or other suitable guide member in the manner described.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for aligning with a predetermined member a substantially flat strap having oppositely located flat sides and passing over the predetermined member in a plane of motion when being unwound in the plane of motion from a roll or the like having an axis of rotation extending substantially parallel to the plane of motion, comprising:

a guide arranged between the roll and the predetermined member and at least partially surrounding the substantially flat strap in laterally guiding relationship with respect to the flat sides of the substantially flat strap;

said guide being aligned with the predetermined member for guiding the substantially flat strap into a position rotated out of the plane of motion of the strap and for guiding the substantially flat strap along a predetermined path in the direction of said predetermined member;

said guide allowing the substantially flat strap to rotate back into said plane of motion subsequent to leaving said guide and while moving along said predetermined path in the direction of said predetermined member;

said guide comprising a guidance gap extending substantially perpendicular to the plane of motion;

mounting means for mounting said guide to be movable in a direction extending transverse to the plane of motion; and said guide including means causing said guide to move in response to a displacement of the plane of motion of the substantially flat strap in said direction extending transverse to the plane of motion of the substantially flat strap.

2. The apparatus as defined in claim 1, wherein:

said predetermined member defines an axis of rotation; and said guide being pivotable about a pivot axis extending substantially parallel to said axis of rotation.

3. The apparatus as defined in claim 1, wherein:

said mounting means comprises a lever pivotable about a pivot axis extending substantially parallel to said plane of motion of the strap;

said guide being mounted on said lever; and means for rotatably journaling said guide on said lever.

4. The apparatus as defined in claim 2, wherein:

said mounting means comprises a lever pivotable about a pivot axis extending substantially parallel to the plane of motion of the strap;

said guide being mounted on said lever; and means for rotatably journaling said guide about an axis extending substantially parallel to said pivot axis of said lever.

5. The apparatus as defined in claim 2, wherein:

said predetermined member is constructed as a roll; and said pivot axis of said lever extending substantially parallel to said axis of rotation of said predetermined member.

6. The apparatus as defined in claim 3, wherein:

said predetermined member defines an axis of rotation;

said predetermined member is constructed as a roll; and said pivot axis of said lever extending substantially parallel to said axis of rotation of said predetermined member.

7. The apparatus as defined in claim 4, wherein:

said predetermined member defines an axis of rotation;

said predetermined member is constructed as a roll; and said pivot axis of said lever extending substantially parallel to said axis of rotation of said predetermined member.

8. The apparatus as defined in claim 1, further including:

guard plates for said strap;

said strap passing through said guidance gap in a continuous longitudinal motion;

said strap performing a lateral motion while passing through said guidance gap; and said guard plates limiting said lateral motion of said strap within said guidance gap in a direction transverse to said continuous motion of said strap through said guidance gap.

9. The apparatus as defined in claim 1, further including:

mutually opposite guide surfaces defining said guidance gap;

said strap having flat surfaces; and said guide surfaces guiding said strap at said flat surfaces thereof.

10. The apparatus as defined in claim 1, further including:

mutually opposite guide bodies forming said guidance gap.

11. The apparatus as defined in claim 10, wherein:

said guide bodies comprise blocks.

12. The apparatus as defined in claim 1, wherein:

said predetermined member is a guide member.

13. The apparatus as defined in claim 1, wherein:

said apparatus is used to align a winding strap unwinding from a wound package of printed products when the printed products are unwound with a guide roll.

14. The apparatus as defined in claim 1, wherein:

the apparatus is used to align a winding strap unwinding from a wound package of printed products when the printed products are unwound with a deflection roll.

15. An apparatus for unwinding a substantially flat partitioning strap directly from a coil of stored products having a substantially cylindrical periphery and a radial plane, wherein the diameter of the coil of stored products diminishes as the partioning strap is unwound and stored products are removed, and wherein the partitioning strap is narrower than the stored products and has an only approximately constant lateral location within the coil of stored products, comprising:

a predetermined member;

the partitioning strap departing tangentially from the substantially cylindrical periphery at a run-off location dependent upon the diminishing diameter of the coil;

said predetermined member and the substantially cylindrical periphery at said run-off location conjointly defining a plane of motion for the partitioning strap;

guide means at least partially surrounding the partitioning strap in intimate guiding relationship and located intermediate said run-off location and said predetermined member;

said guide means being oriented to cause the partitioning strap to rotate out of said plane of motion by substantially 90° in the region of said guide means;

said predetermined member being oriented to cause the partitioning strap to rotate back substantially into said plane of motion subsequent to said guide means; and hingedly movable mounting means for said guide means for enabling said guide means to perform a substantially vertical movement in a direction extending substantially parallel to the radial plane of the coil of stored products for allowing said guide means to follow the partitioning strap as said plane of motion moves in a direction transverse to said plane of motion in response to the diminishing diameter of the coil of stored products while maintaining said guide means in accurate lateral alignment with said predetermined member such that the partitioning strap runs onto said predetermined member in a substantially constant orientation and at a substantially constant lateral location irrespective of possible slight variations in lateral location of the partitioning strap within the coil of stored products being unwound.

16. An apparatus for unwinding a substantially flat partitioning strap having oppositely located flat sides directly from a coil of stored products having a substantially cylindrical periphery and a radial plane, wherein the diameter of the coil of stored products diminishes as the partitioning strap is unwound and stored products are removed, and wherein the partitioning strap is narrower than the stored products and has an only approximately constant lateral location within the coil of stored products, comprising:

a predetermined member;

the partitioning strap departing tangentially from the substantially cylindrical periphery at a run-off location dependent upon the diminishing diameter of the coil;

said predetermined member and the substantially cylindrical periphery at said run-off location conjointly defining a plane of motion for the partitioning strap;

guide means at least partially surrounding the partitioning strap in guiding relationship with respect to the flat sides of the substantially flat strap and located intermediate said run-off location and said predetermined member;

said guide means being oriented to cause the partitioning strap to rotate out of said plane of motion by substantially 90° in the region of said guide means;

said predetermined member being oriented to cause the partitioning strap to rotate back substantially into said plane of motion subsequent to said guide means; and movable mounting means for said guide means for enabling said guide means to perform a movement in a direction extending substantially parallel to a radial plane of the coil of stored products for allowing said guide means to follow the partitioning strap as said plane of motion moves in a direction transverse to said plane of motion in response to the diminishing diameter of the coil of stored products while maintaining said guide means in accurate lateral alignment with said predetermined member such that the partitioning strap runs onto said predetermined member in a substantially constant orientation and at a substantially constant lateral location irrespective of possible slight variations in lateral location of the partitioning strap within the coil of stored products being unwound.

* * * * *